US011766376B2

(12) United States Patent
Barragan Gomez

(10) Patent No.: US 11,766,376 B2
(45) Date of Patent: Sep. 26, 2023

(54) ASSISTED REHABILITATION SYSTEM

(71) Applicant: UNIVERSIDAD AUTÓNOMA DE BUCARAMANGA, Santander (CO)

(72) Inventor: Johann Barragan Gomez, Bucaramanga (CO)

( * ) Notice: Subject to any disclaimer, the term of this patent is extended or adjusted under 35 U.S.C. 154(b) by 821 days.

(21) Appl. No.: 16/620,783

(22) PCT Filed: Jun. 5, 2018

(86) PCT No.: PCT/IB2018/054026

§ 371 (c)(1),
(2) Date: Dec. 9, 2019

(87) PCT Pub. No.: WO2018/224967

PCT Pub. Date: Dec. 13, 2018

(65) Prior Publication Data

US 2020/0179210 A1 Jun. 11, 2020

(30) Foreign Application Priority Data

Jun. 9, 2017 (CO) ..... NC2017/0005734

(51) Int. Cl.
*A61H 1/02* (2006.01)
*A63B 22/06* (2006.01)
(Continued)

(52) U.S. Cl.
CPC ..... *A61H 1/0214* (2013.01); *A63B 21/0058* (2013.01); *A63B 21/00178* (2013.01);
(Continued)

(58) Field of Classification Search
CPC ..... A61H 1/0214; A61H 2201/1207; A61H 2201/1642; A61H 2201/5071;
(Continued)

(56) References Cited

U.S. PATENT DOCUMENTS 2,565,348 A * 8/1951 Brockman ..... A61H 1/0274 601/36
2,735,422 A * 2/1956 Jones ..... A63B 22/0694 601/36
(Continued)

*Primary Examiner* — Sundhara M Ganesan
(74) *Attorney, Agent, or Firm* — Eugenio J. Torres-Oyola; Victor M. Rodriguez-Reyes; Rafael Rodriguez-Muriel

(57) ABSTRACT

The present invention relates to an assisted rehabilitation system comprising a device with static-bicycle movement, and devices that automatically sense and manipulate body performance parameters, allowing the rehabilitation response process of a user to be optimised. In particular, the sensing devices measure the pedalling rate, the pedalling resistance and the user's pulse rate, allowing the optimum exercising range to be configured, depending on the data acquired from the patient and on the level of effort required from him or her. The system also comprises two motors. One motor drives a flywheel that allows the user to experience a variation in the pedalling rate while using the device. A second motor provides different levels of pedalling resistance, allowing muscular strength to be developed. When starting the activity, the user enters, on a touchscreen, the preliminary parameters for the desired pedalling rate and resistance level, which are analysed by a processing unit that calculates a suitable rehabilitation plan.

9 Claims, 11 Drawing Sheets

(51) Int. Cl.
*A63B 21/005* (2006.01)
*A63B 21/00* (2006.01)
*A63B 22/00* (2006.01)

(52) U.S. Cl.
CPC ..... *A63B 22/06* (2013.01); *A63B 22/0605* (2013.01); *A61H 2201/1207* (2013.01); *A61H 2201/1642* (2013.01); *A61H 2201/5071* (2013.01); *A63B 2022/0094* (2013.01)

(58) Field of Classification Search
CPC .... A61H 2201/0173; A61H 2201/1463; A61H 2201/1633; A61H 2201/1635; A61H 2201/1671; A61H 2201/5046; A61H 2201/5058; A61H 2205/10; A61H 2230/06; A61H 1/00; A63B 21/00178; A63B 21/0058; A63B 22/06; A63B 22/0605; A63B 2022/0094
See application file for complete search history.

(56) References Cited

U.S. PATENT DOCUMENTS 3,767,195 A * 10/1973 Dimick ..... A63B 24/00 482/64
4,709,917 A * 12/1987 Yang ..... A63B 22/0605 434/61
5,071,117 A * 12/1991 Mautner ..... A63B 22/0007 482/57
5,267,925 A * 12/1993 Boyd ..... A63B 21/0055 482/64
5,292,293 A * 3/1994 Schumacher ..... A63B 24/00 482/4
5,410,472 A * 4/1995 Anderson ..... G16H 20/30 601/1
5,722,915 A * 3/1998 Reck ..... A63B 21/00178 482/4
5,860,941 A * 1/1999 Saringer ..... A61H 1/0214 601/36
7,357,209 B2 * 4/2008 Kokatsu ..... B62M 6/45 180/206.4
9,248,071 B1 * 2/2016 Benda ..... A63B 71/0009
2003/0109814 A1 * 6/2003 Rummerfield ..... A61H 1/0214 601/24
2003/0153436 A1 * 8/2003 Ho ..... A63B 21/0058 482/63
2004/0067476 A1 * 4/2004 Reck ..... A63B 21/005 434/262
2006/0094569 A1 * 5/2006 Day ..... A63B 24/00 482/57
2006/0247095 A1 * 11/2006 Rummerfield ..... A61H 1/0214 482/57
2009/0233767 A1 * 9/2009 Huang ..... A63B 22/0605 482/57
2011/0111923 A1 * 5/2011 Bacanovic ..... A63B 22/0605 482/8
2011/0172059 A1 * 7/2011 Watterson ..... A63B 24/0062 482/5
2011/0294624 A1 * 12/2011 Burnfield ..... A63B 24/0087 482/145
2012/0178592 A1 * 7/2012 Chieh ..... B62M 6/40 482/57
2012/0329611 A1 * 12/2012 Bouchard ..... A61H 1/0214 482/57
2013/0059698 A1 * 3/2013 Barton ..... A63B 71/0622 482/63
2013/0245511 A1 * 9/2013 Pidcoe ..... A61H 1/001 601/33
2013/0345025 A1 * 12/2013 van der Merwe . A63B 22/0605 482/7
2014/0194251 A1 * 7/2014 Reich ..... A63B 21/00178 482/6
2014/0274565 A1 * 9/2014 Boyette ..... A63B 22/0694 482/6
2015/0011362 A1 * 1/2015 Oh ..... A63B 22/0605 482/9
2015/0250675 A1 * 9/2015 Kalinowski ..... A63B 22/001 482/69
2018/0056111 A1 * 3/2018 Chiang ..... A63B 22/0605
2018/0117401 A1 * 5/2018 Chen ..... A63B 22/0605
2018/0200566 A1 * 7/2018 Weston ..... A63B 71/0622
2019/0031284 A1 * 1/2019 Fuchs ..... A63B 22/0605
2019/0192914 A1 * 6/2019 Langford ..... A63B 21/00196

* cited by examiner

ASSISTED REHABILITATION SYSTEM

FIELD OF THE INVENTION

The present invention relates to a system for assisted rehabilitation for recently operated patients or patients with injuries that prevent or limit continuous movement of lower extremities.

SUMMARY OF THE INVENTION

The present invention is directed to a system for assisted rehabilitation comprising a movement static exercise-bicycle-type device and devices for automatically sensing and manipulating corporal performance parameters, which allows for optimizing a patient's response to the rehabilitation process. Particularly, the sensing devices measure the cadence of pedaling, the resistance to pedaling, and the user's pulse, allowing for configuring the optimum range for a patient's exercises depending on the data retrieved from said patient and the required level of effort. The system also comprises two engines. One engine (6) drives a flywheel, which allows the patient to experiment with a variation of the cadence of the pedaling while the device is being used. A second engine (3) provides different levels of resistance to the pedaling, which allows for working on muscle strength. When starting an activity, the patient may enter into the system, through a touchscreen, the preliminary parameters for the desired pedaling cadence and resistance, which the device will then analyze and use to calculate the proper rehabilitation plan. The touchscreen may also display the patient's pulse, revolutions per minute of the pedaling cadence and the level of pedaling resistance.

CURRENT STATE OF THE ART

It is known that stationary bicycles allow a person to exercise by pedaling. Stationary bicycles are normally used in gyms or at home when the weather does not allow for riding a bicycle outdoors; or simply used for training purposes. Stationary bicycles are also used for physical therapy and/or rehabilitation because they allow for the exercising and strengthening of certain muscles and joints without the risk of falling.

After a hip or knee injury or surgery, one of the top priorities is starting to restore the affected joint's range of movement. The typical range of movement for joints like knees may be measured by its flexion and extension using a goniometer.

A goniometer has two pieces that are connected by a central hinge aligning each of said pieces along a specific joint section, each piece being able to move individually or together and providing a measurement in degrees. Typical maximum flexion values for a knee are between 0° and 10°. The same method may be used for a hip; a hip's maximum flexion is approximately 130°, the extension of a hip is approximately between 10° and 15°, its rotation is between 30° and 40°, its abduction is approximately 40°, and its adduction is approximately between 15° and 20°. These are typical values for a healthy person and may vary from patient to patient. After an injury or surgery usually there is a significant drop in a patient's movement range.

There are devices known in the art that help in the recovery of patients that have recently had surgery on their lower and upper extremities which generally comprise electric bands that allow repetitive movement during rehabilitation sessions.

For lower extremities, Spanish patent no. ES1062501 discloses a motorized stationary bicycle that includes a variable speed engine that promotes pedaling movements for lower extremities. The motorized pedaling device may be used at rehabilitation centers, hospitals and gyms. The bicycle comprises a reduction drive (1) that transmits variable speed movement through a pinion and a plate (2) which is engaged by means of a chain or belt (3) to the pedals that have a specific design and have rear tops and sides that allow the patient to keep the feet lodged inside them. The structure of the bicycle is made of aluminum or other similar material, having a main base (11) that supports the weight of the bicycle, front and rear transverse supports (10) and a vertical support (7) where the handlebar is supported (8) with its display (9). The chair's (5) horizontal displacement is regulated by an engine. Said chair has folding armrests (6) and a housing (12) to cover the entire gear system.

U.S. Patent application No. US2012/0329611, discloses a motorized apparatus and a method for the rehabilitation of disabled and/or handicapped individuals to train properly, where the device increases blood flow, releases tension and reconditions the muscles and lower body joints. The device comprises a powered stationary bicycle that comprises a seat, handles and rotating foot pedals that receive motor input from an electric engine and/or from the user. The device also includes a pair of thigh straps that are connected between the user's thighs through an articulated link which prevents the extremities from being involuntarily separated in patients that have no leg movement. The device also has a chain that controls and trains the limbs of the patient through the rotation of the pedal. The described method further combines the bicycle device for rehabilitation together with visual stimuli in the form of a three-dimensional television screen that stimulates endorphins, relieves mental stress and allows motor entry from the bicycle and the user to exercise the limbs, without being focused on the rehabilitation activity.

U.S. Pat. No. 3,767,195 discloses an exercise apparatus in the form of a stationary bicycle in which the torsion load on the pedals is adjusted through a predetermined cycle of operation by a servomotor that applies a friction load on a steering wheel operated by the pedals. The control loop includes a bridge circuit, coupled to the servomotor, sensitive to the amount of torque currently being applied by the servomotor and where, the control loop adjusts the torque to a reference parameter provided by a programming device. This device includes resistors connected in series that are scanned by a mobile contact coupled to a clock motor to provide a variation of the torque load on the pedals.

Stationary bicycles benefit patients as they have a very defined range of movement and a decrease in resistance to pedaling, affecting muscle tone when the pedals have a constant turning radius, and creating a uniform circumference when they are turned, helping patients who cannot fully develop the rotational movement of the lower extremities. However, there is a need for assisted rehabilitation systems that allow to accurately measure the patient's performance in each therapy session and that help with the recovery of mobility of the lower extremities by means of a plan of systematic and programmable exercise that conforms to the user's requirements. The assisted rehabilitation system of the present invention may also be applied towards the treatment of patients suffering from diseases such as Parkinson's. The symptoms of this disease can be reduced by subjecting the patient to exercise routines with a constant pedaling frequency of 90 revolutions per minute during daily training sessions of 45 minutes. Another application of this device may be in patients suffering from permanent immobility of the lower extremities, as is the case of patients in a state of paraplegia. For this application, the patient can be suspended by means of an external crane-type device, securing his lower limbs to the legs. The engine is capable of generating the momentum necessary to move the legs at a constant rotation speed for the period of time required by the patient. There is also an important application aimed at athletes who need to precisely control the level of resistance, the rate of pedaling and heart rate in a training routine.

DETAILED DESCRIPTION OF THE INVENTION

A system for rehabilitation of patients with limitations in the mobility of the lower extremities caused by different causes such as stroke, spinal cord injuries and neurodegenerative diseases such as Parkinson's disease is described below, based on the accompanying figures. The machine drive generates the continuous movement of the lower extremities with different degrees of assistance to the patient depending on the stage of treatment on which the patient currently is.

Figure 1:
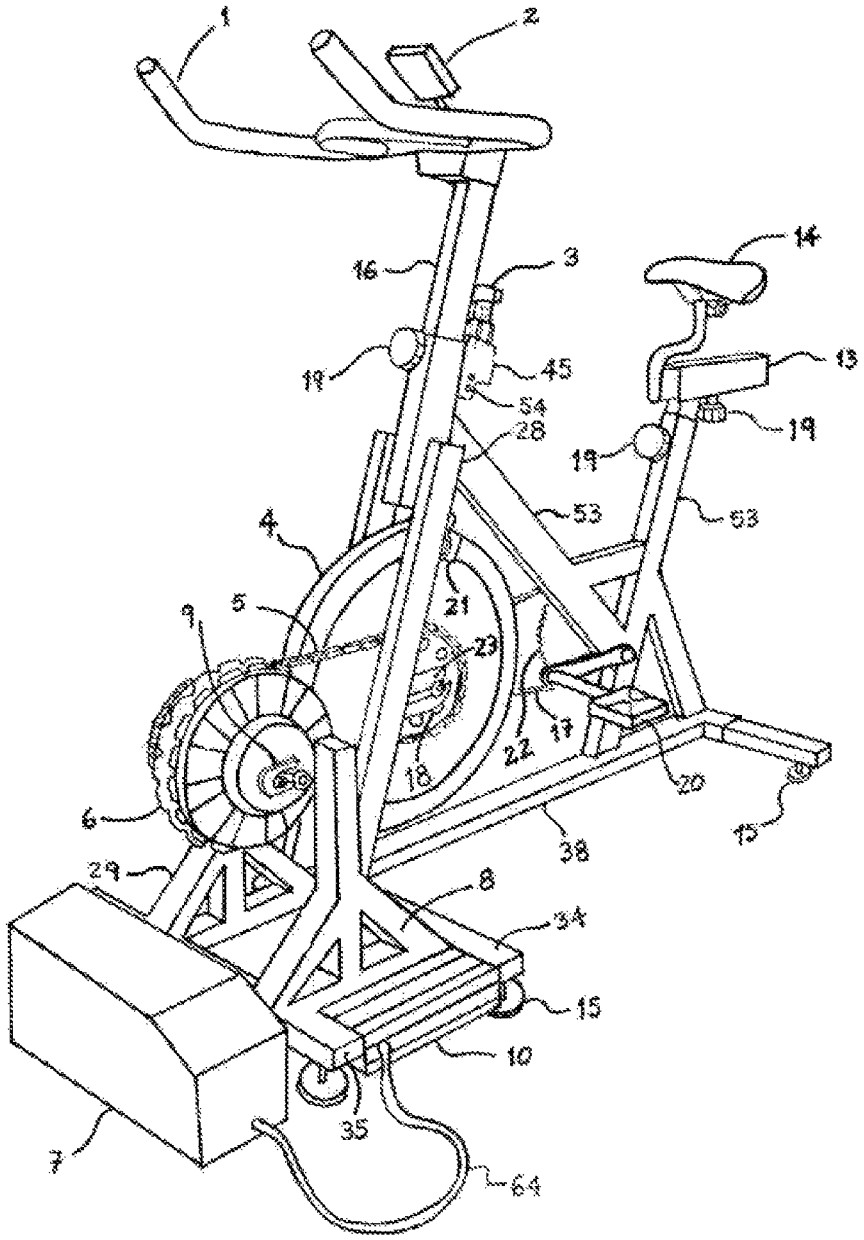
FIG. 1 shows the general assembly of an embodiment of the present invention.
Figure 5:
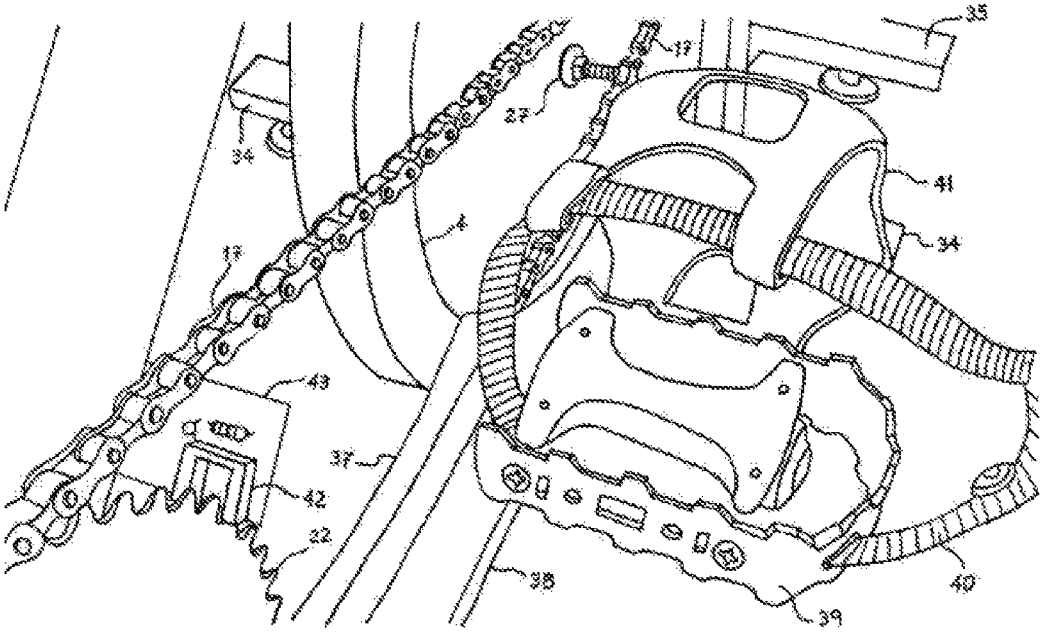
FIG. 5 shows the photo-transmitting pulse sensor (42) that measure the rotation speed of the left (20) and right (39) pedals at any moment when reading the stride frequency of the serrated pulley's (22) teeth, which is driven by the pedals (20) (39) through the crank (37).
Figure 8:
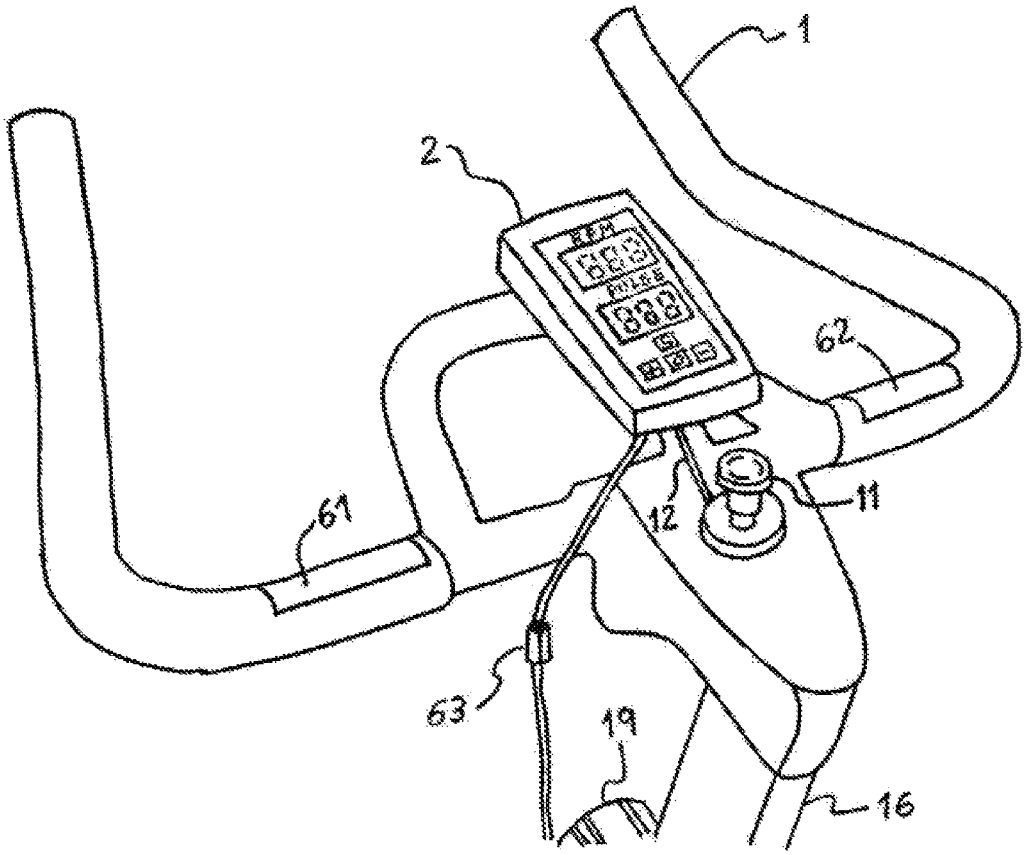
FIG. 8 shows a touchscreen (2) with which the user interacts and the heart pulse sensors (61) and (62) located on the handlebar (1). The emergency stop button (11) is also shown.

As can be seen in FIG. 1, the general assembly of the device for assisted rehabilitation of the present invention comprises a handlebar (1) that allows the user to support his/her upper extremities during the rehabilitation phase. In addition, it comprises a touch screen (2) that acts as a communication interface between the user and the machine. An engine (3) allows the user to automatically adjust the resistance to pedaling and also fulfills the function of executing the emergency stop in case of an abnormal situation in the exercise session. The emergency stop command is activated by pressing the emergency stop button (11) (FIG. 8). The pedaling resistance is measured by means of a pressure sensor (71) (FIG. 11) located in one of the brackets of the brake shoe (21) of the assisted rehabilitation system or bicycle. The flywheel (4) allows for a reduction of the angular velocity fluctuations that the system could present, making the transition between speeds smoother when variation takes place. The speed regulation motor (6) transfers the movement to the flywheel (4) by means of a chain transmission consisting of a first toothed pulley (18) and a second toothed pulley (26) (FIG. 3) and a front transmission chain (5). The distance between the centers of the first and second toothed pulleys (18) and (26) (FIG. 3) is adjusted by means of screws that are housed in the tongue (9) and (31) (FIG. 3) at the ends of the support shaft (73) (FIG. 10) of the speed regulator motor (6). Said motor (6) rests on a metal structure formed by two vertical supports (8) and (29) which in turn are joined with two rectangular profiles (34) and (35) that give enough rigidity to the transmission system. The metal structure (8), (29), (34) and (35) also serves to cover the housing (10) in which the control and power electronics are located. The electronics module is powered by a bank of batteries that are in the container (7). The electrical connection between the battery bank (7) and the housing (10) containing the control and power electronics is achieved by means of the power cable (64). The measurement of the rotation speed of the pedals is carried out by means of a photo-transmitter pulse sensor (42) (FIG. 5) that is positioned in such a way that it reads the stride frequency of the pulley teeth from a third toothed pulley (22) (FIG. 5) which is attached to the pedals (20) and (39) (FIG. 5) through the connecting rod (37) (FIG. 5). Through a mathematical equation, the relationship between the pulses generated by the photo transmitter and the pedaling rate can be known. FIG. 1 also shows other elements such as the sliding guide (13) used to horizontally adjust the saddle (14), the rubber supports (15) to prevent the sliding of the structure on the floor on which it is located, and the rear transmission chain (17) that allows the transmission of rotational movement between the flywheel and the pedals. Finally, there is the lower support (38) that helps to stiffen the frame of the bicycle (53).

Figure 2:
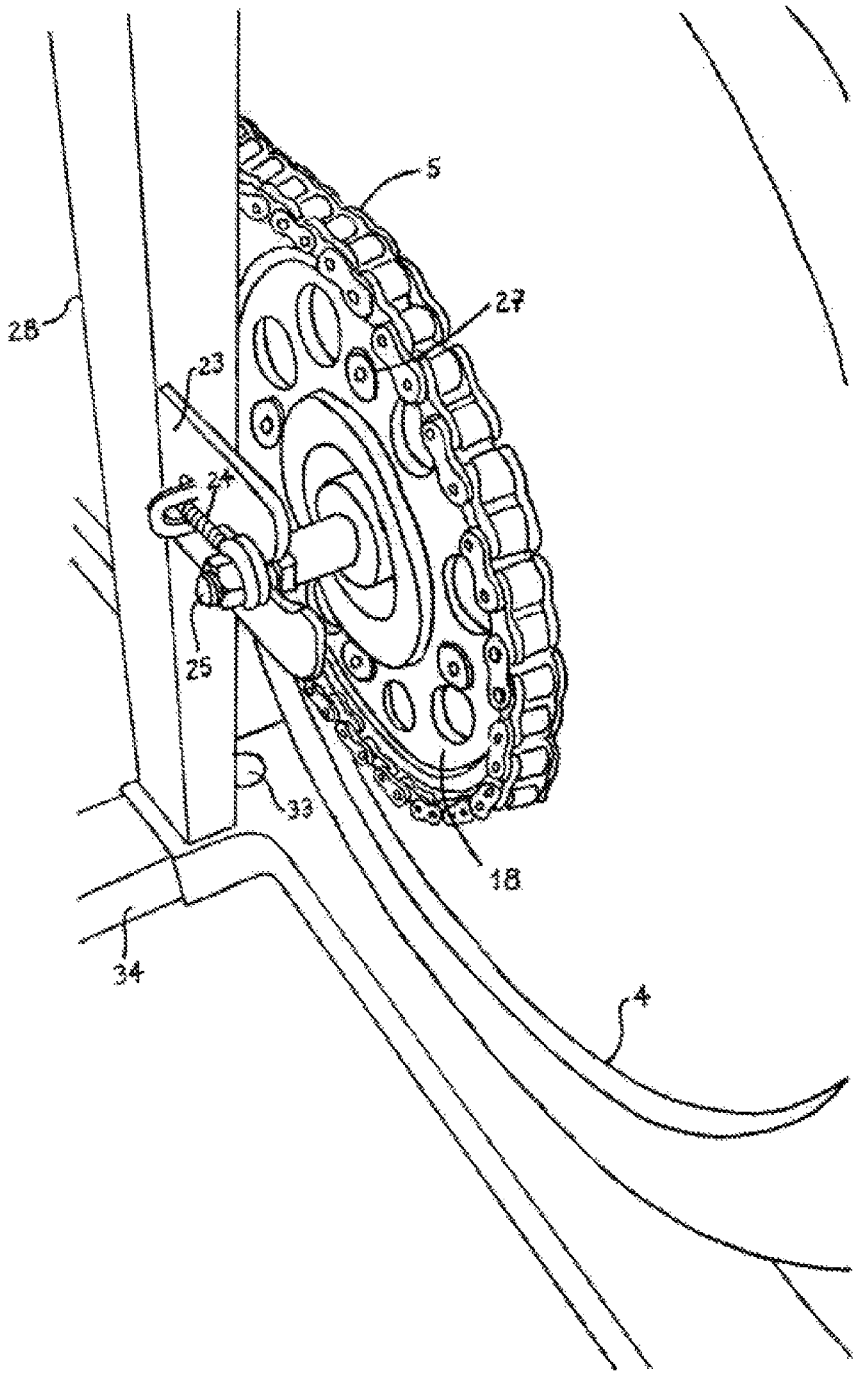
FIG. 2 shows a detailed view of the fastening system of the serrated pulley (18) joined to the bicycle's flywheel (4).
Figure 3:
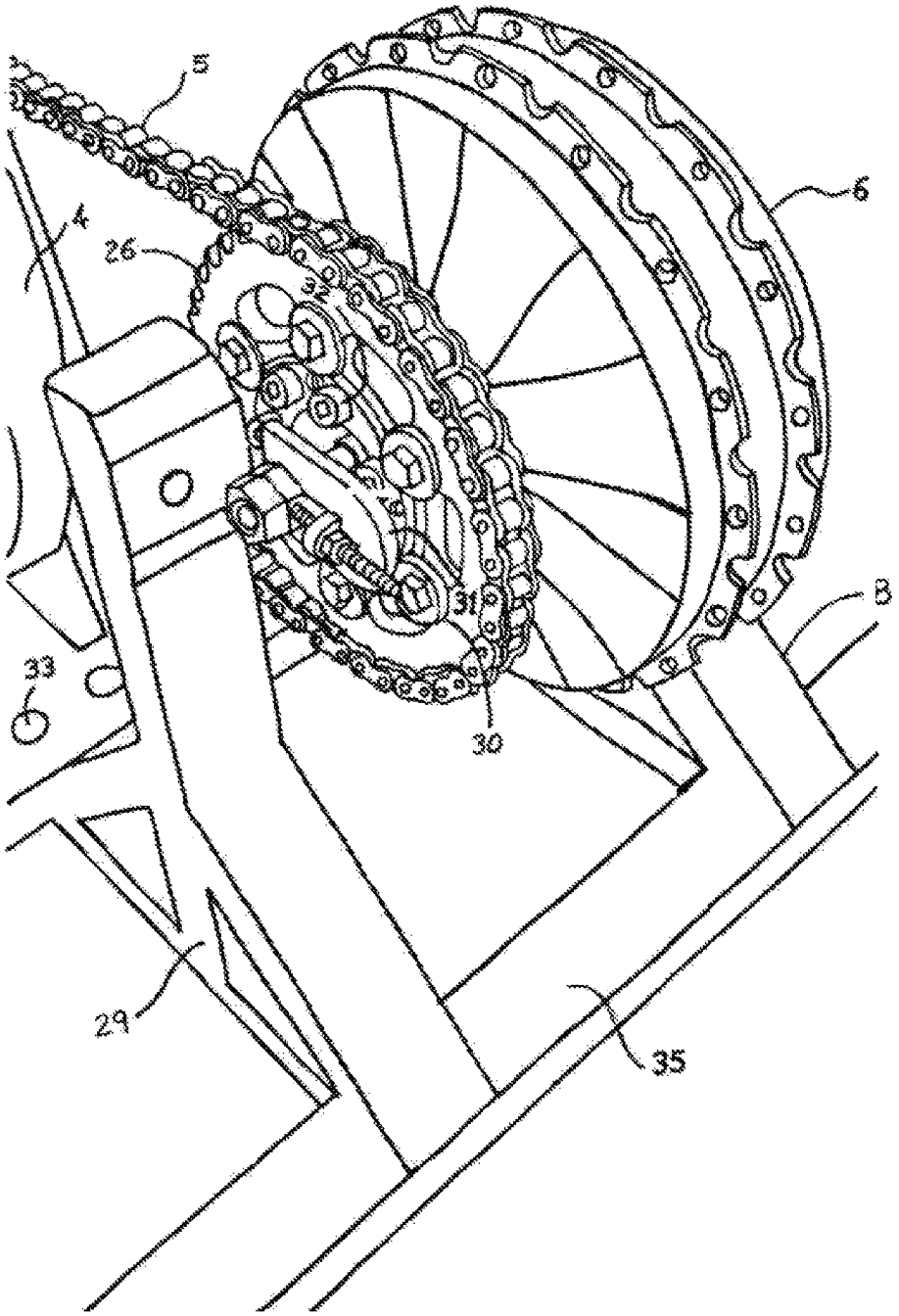
FIG. 3 shows the fastening screws (32) of the external fastening system of the serrated pulley (26) joined to the engine (6) that regulates de rotation speed of the pedals.

FIG. 2 shows the detail of the clamping system of the first toothed pulley (18) joined to the flywheel (4) of the assisted rehabilitation system of the invention or bicycle. The union of the first toothed pulley (18) with the flywheel (4) is achieved by means of four screws (27) that pass through the flywheel (4). FIG. 2 also shows the way in which the screws (33) are used to join the front support (28) of the bicycle frame (53) (FIG. 1) with the rear rectangular profile (34) of the support structure The rear screw (24) is used to obtain the distance between pulley centers (18) and (26) (FIG. 3). The rear tab (23) supports the axle (25) of the flywheel (4).

FIG. 3 shows the fixing screws (32) of the external clamping system of the second toothed pulley (26) to the motor (6) that regulates the rotation speed of the pedals (20) (FIG. 1) and (39) (FIG. 5). The screws (30) for adjusting the second toothed pulley (26) attached to the motor (6) pass through the second toothed pulley (26). The fixing screws of the external fastening system (32) are used to fix a frictional power transmission system which has the advantage of taking up little space. FIG. 3 also shows previously described elements such as the flywheel (4), the screws (33), the front transmission chain (5), the components of the engine support structure (6), and support elements (8), (29) and (35). The right tongue (31) and the left tongue (9) (FIG. 1) support the shaft (73) (FIG. 10) of the motor (6). These tabs are also used to tense the front drive chain (5), by means of the front screws (67) (FIG. 10) for adjusting the distance between pulley centers, by locating the second toothed pulley (26) to the recommended distance for this type of transmission.

Figure 4:
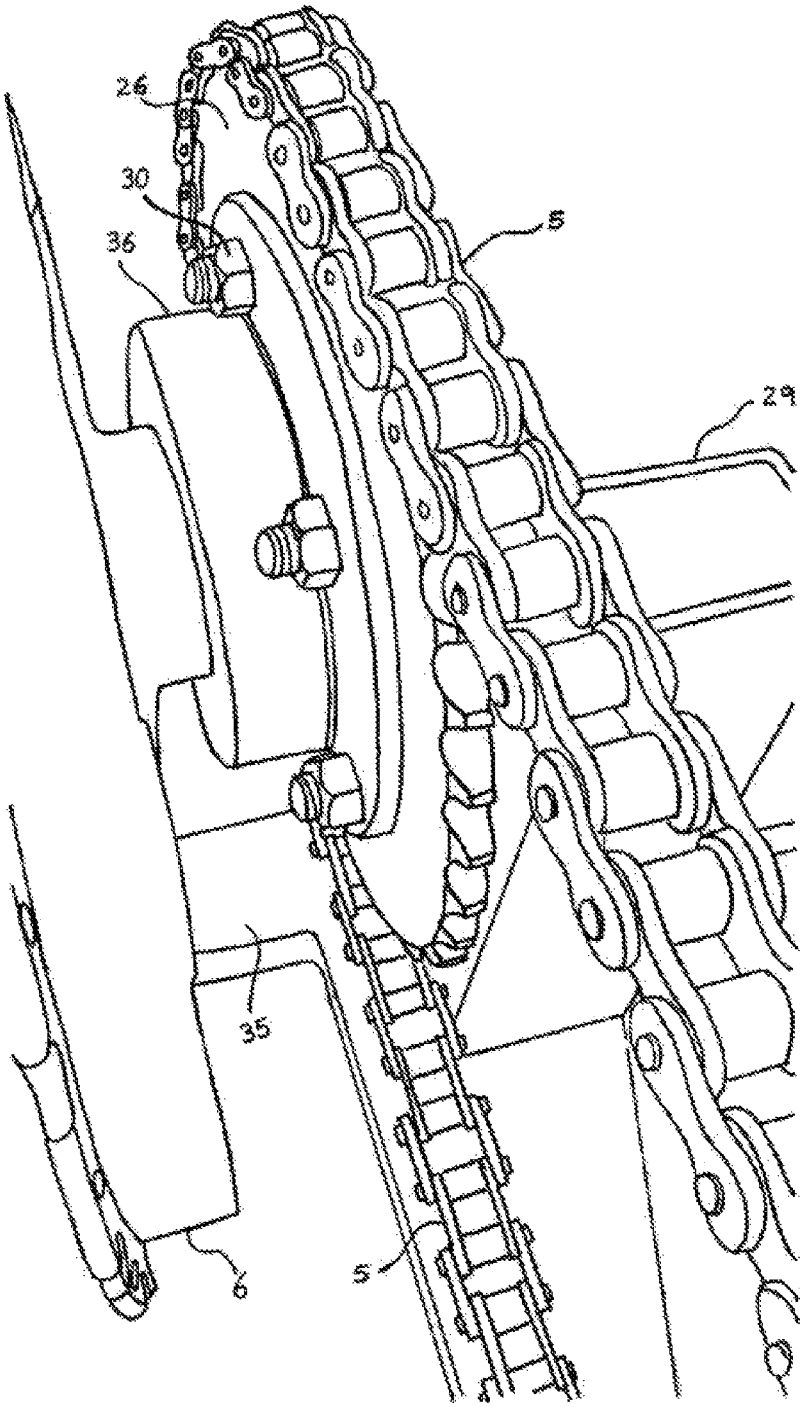
FIG. 4 shows the internal fastening system (36) of the serrated flywheel (26) joined to the engine (6) that regulates the rotation speed of the pedals.

FIG. 4 shows the internal fastening system (36) of the second toothed pulley (26) to the motor (6) that regulates the rotation speed of the pedals (20) (FIG. 1) and 39 (FIG. 5). The block (36) internally accommodates the friction power transmission system that is fixed with the screws (32) (FIG. 3). The screws (30) that pass through the second toothed pulley (26) are also observed, allowing it to rotate in solidarity with the motor (6). FIG. 4 also shows other elements previously described as the chain (5) and elements belonging to the motor support structure (6) such as the rectangular front profile (35) and the right vertical support (29).

FIG. 5 shows the pulse photo-transmitter sensor (42) that measures the rotation speed of the left (20) (FIG. 1) and right (39) pedals at any time when reading the stride frequency of the teeth of the third toothed pulley (22) that is attached to the pedals (20) (FIG. 1) and (39) through the connecting rod (37). The photo-transmitter sensor (42) is mounted on a printed circuit board (43) which houses the necessary components to acquire the signal generated by the sensor (42). Additionally, the toe-clip system (40) and (41) by which the user's foot is fixed to the pedal (39) is shown. Also shown in FIG. 5 are other components such as the flywheel (4), the rear drive chain (17) that transfers the rotational movement between the pedals (20) (FIG. 1) and (39) and the flywheel of inertia (4). The connecting rod (37) of the right pedal (39) is observed. One of the four through screws (27) that pass through the flywheel (4) also appears to allow the first toothed pulley (18) to be secured (FIG. 2) on the left side of the flywheel (4). Finally, the rear rectangular profile (34) and the rectangular front profile (35) of the motor support structure (6) (FIG. 3) that regulates the pedaling rate are observed.

Figure 6:
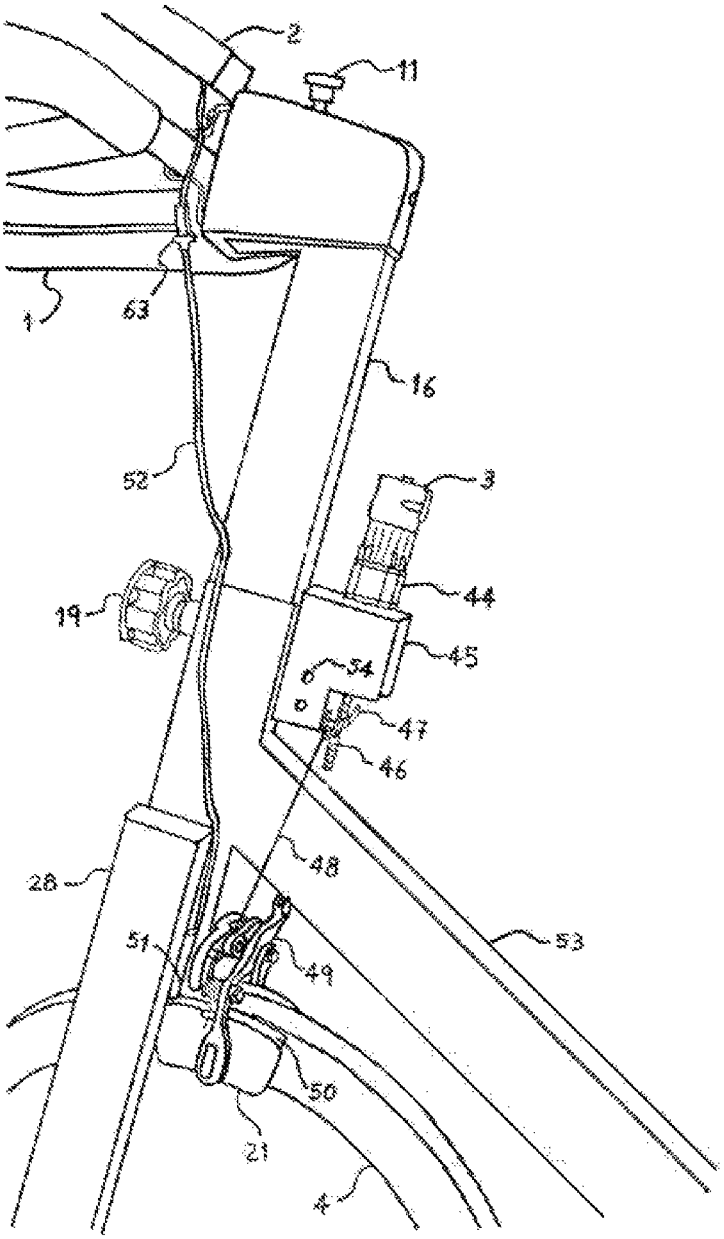
FIG. 6 shows a left side view of the engine (3) and the reduction gear assembly (44) that automatically regulates the pedaling resistance.

FIG. 6 shows the motor (3) and the gear reducer (44) that automatically regulate the pedaling resistance. The motor (3), and the gear reducer (44) are fixed to the frame (53) of the bicycle by means of two screws (58) (FIG. 7) that rest on the holes (54) of the plate support (45). The gear reducer (44) rotates in solidarity with the screw shaft (46), which gradually tenses the steel cable (48) which in turn drives the braking mechanism (49). This way different degrees of resistance to pedaling are obtained which precision is given by the passage of the screw shaft (46). Between the brake shoe support (21) and the brake shoe (50) there is a pressure sensor (71) (FIG. 11) whose output signal is sent to the control system (10) and to it time to the touch screen (2) by means of the signal conductor cable (52). The signal from the pressure sensor (71) (FIG. 11) is conditioned with the filter (51). FIG. 6 also shows other elements such as the steering wheel (4), the front support (28) of the frame (53) of the bicycle, the height adjustable link (16) of the handlebar (1), the anchor knob (19), the sensor cable connector (63) and the emergency stop button (11).

Figure 7:
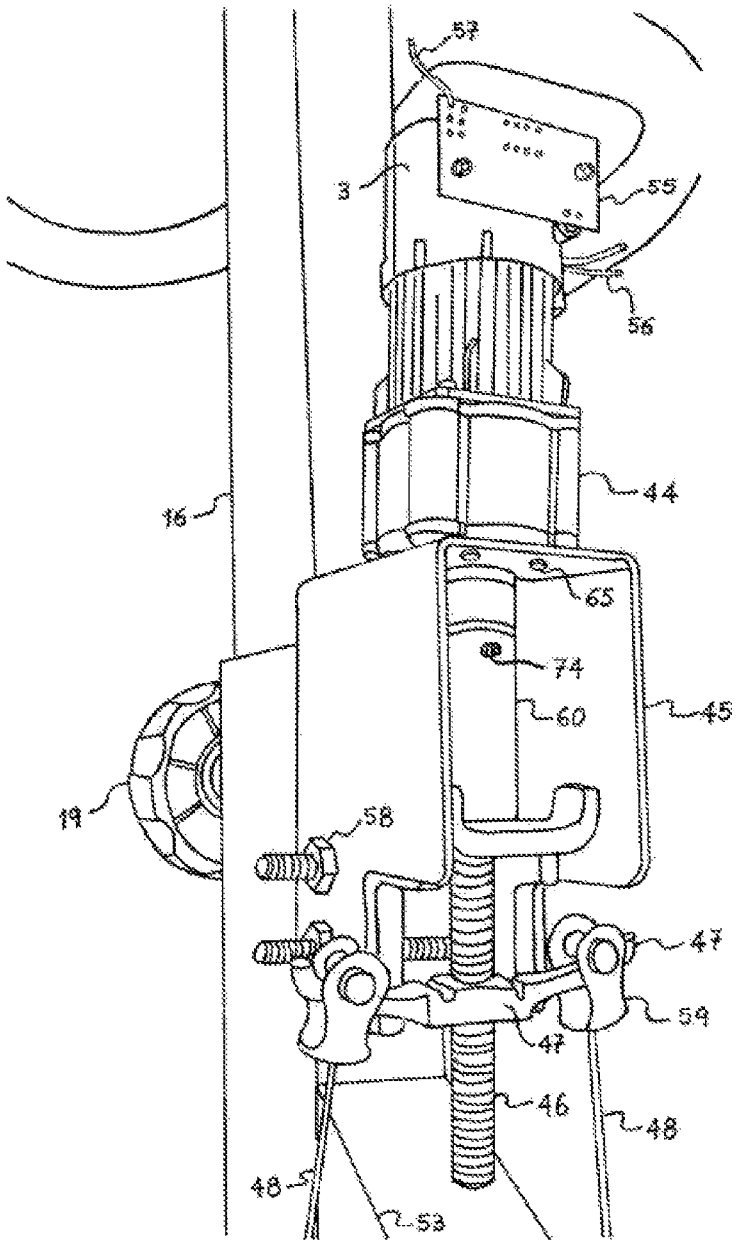
FIG. 7 shows a detailed view of the engine (3) and the reduction gear assembly (44) that automatically regulates the pedaling resistance.
Figure 9:
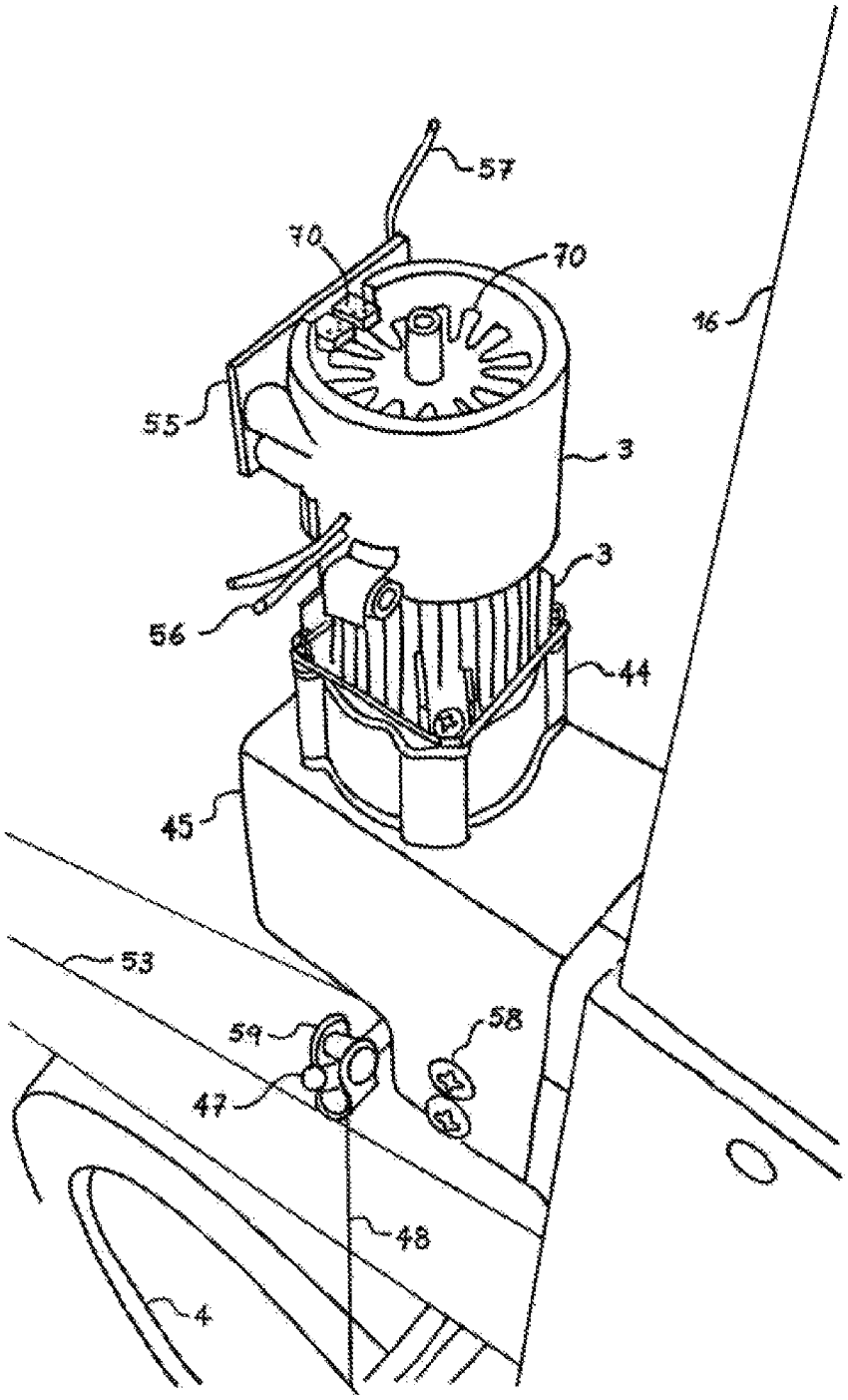
FIG. 9 shows a detailed view of the encoder (70) that measures the angular position of the screw's (46) axis (FIG. 7) joined to the reduction gear assembly (44) that regulates the pedaling resistance.

FIG. 7 shows a detailed view of the motor (3) and the gear reducer (44) that automatically regulate the resistance to pedaling. The motor (3) consists of an encoder (70) (FIG. 9) and a gear reducer (44). The electronic circuit (55) allows the encoder pulses to be read (70) (FIG. 9). The electronic circuit (55) is powered by wires (56). The encoder signal (70) (FIG. 9) is obtained by the cable (57). The gear reducer (44) is coupled to the shaft (60) which is joined with said gear reducer (44) by means of a set screw (74). At the end of the shaft (60) is the threaded part (46) for the tension nut (47) of the steel cable, thus vertically moving the steel cables (48) that in turn actuate the braking mechanism (49) (FIG. 6). The motor (3) and the gear reducer (44) are joined in solidarity with the support plate (45) by means of screws (65) located at the end of the gear reducer (44). The support plate (45) in turn is connected to the frame (53) of the bicycle by means of the through screws (58) (FIG. 7) and (FIG. 9). Also shown in FIG. 7 are other components such as the adjustable height link (16) of the handlebar (1), the anchor knob (19) and the tensioner (59) of the steel cable (48).

FIG. 8 shows the touch screen (2) with which the user interacts and the heart rate sensors (61), (62) located on the handlebar (1). The touch screen (2) displays in the user-machine interface, the pedaling rate in revolutions per minute, the heart rate and the resistance level at any time. The pedal rotation speed signal from the photo-transmitter sensor (42) (FIG. 5) is transmitted to the touch screen (2) by means of the sensor signal lead wire (52) (FIG. 6) which is attached to the touch screen cable through the sensor cable connector (63). The pressure sensor signal (71) (FIG. 11) and the signal from the heart rate sensors (61) and (62) are also obtained via the sensor signal lead wire (52) (FIG. 6). The emergency stop button (11) allows the user to immediately stop the rotational movement of the motor (6) and the rotational movement of the pedals (20) (FIG. 1) and (39) (FIG. 5) at any time. The emergency stop button (11) communicates with the touch screen (2) via the signal lead wire (12). FIG. 8 also shows the anchor knob (19) and the adjustable height link (16) of the handlebar (1).

FIG. 9 shows a detailed view of the encoder (70) that allows measuring the angular position of the screw shaft (46) (FIG. 7) that is joined with the gear reducer (44) of the motor (3). Other components such as the support plate (45), screws (58) through the support plate (45), the steel cable tensor (59), the steel cable (48) and the flywheel are also shown (4).

Figure 10:
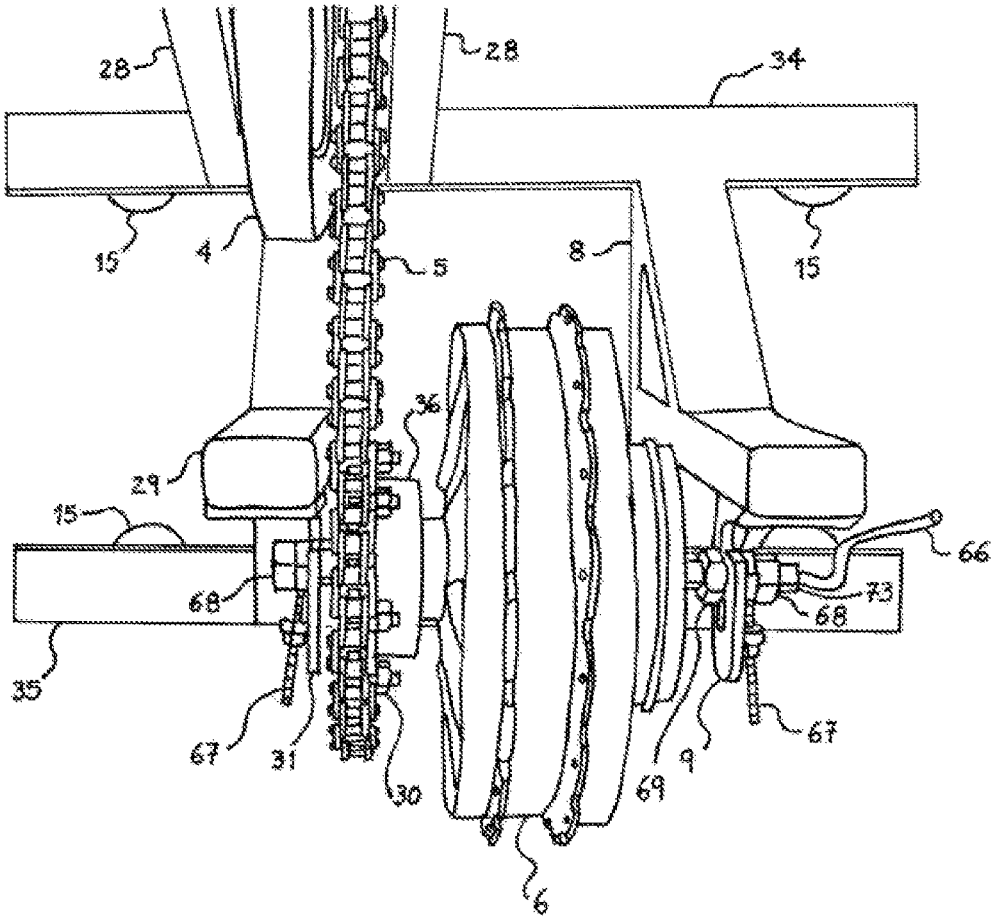
FIG. 10 shows the top view of the speed regulating motor's (6) anchoring system to the support structure (8), (29), (34) and (35).

FIG. 10 shows the top view of the motor anchoring system (6) to the support structure (8), (29), (34) and (35). The shaft (73) of the motor (6) rests on the tabs (9) and (31). The support shaft (73) of the speed regulator motor (6) is axially adjusted by means of the external adjustment nuts (68) and the internal adjustment nuts (69). The front screws (67) allow adjusting the distance between pulley centers (18) (FIG. 2) and (26) (FIG. 3) on which the chain (5) is engaged. The left tongue (9), the right tongue (31), the adjusting screws (30) of the second toothed pulley (26) (FIG. 3), the power cable (66) of the speed regulating motor (6), the flywheel (4) and the front supports (28) of the bicycle frame (53) (FIG. 1) can also be seen.

Figure 11:
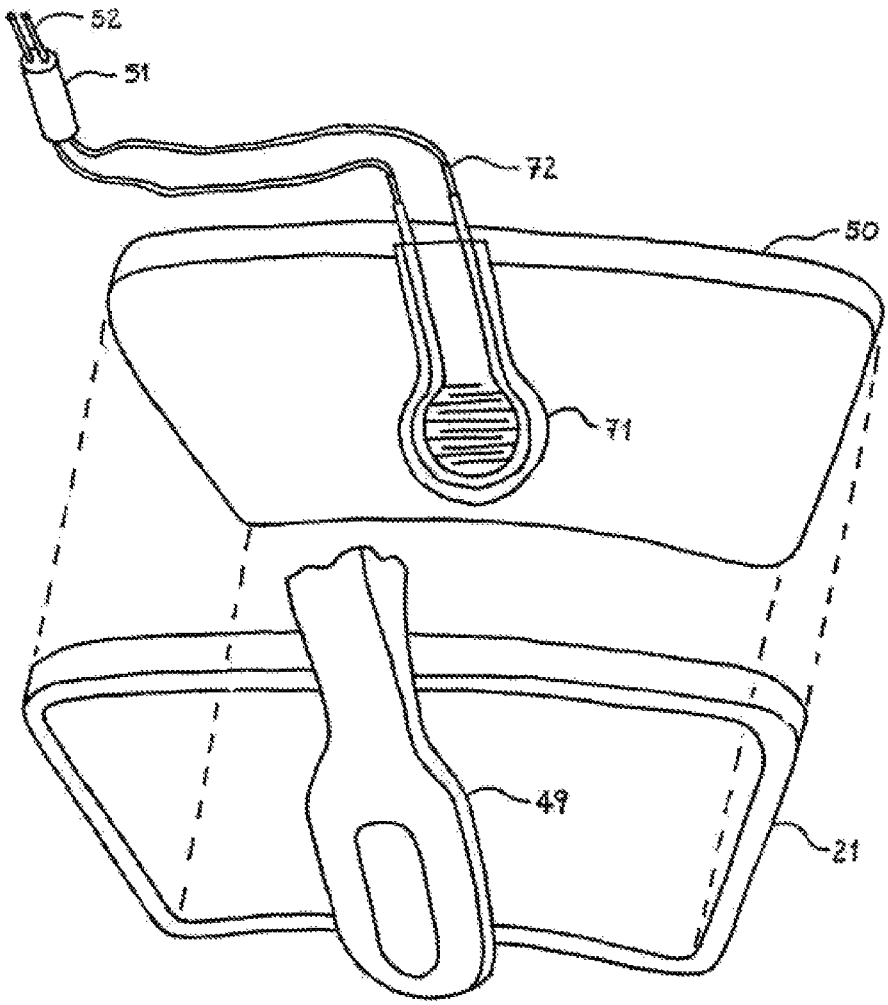
FIG. 11 shows an exploded detailed view of the pressure sensor (71) that is located between the brake shoe's support (210 and the break shoe (50).

FIG. 11 shows the exploded detailed view of the pressure sensor (71) that is located between the brake shoe support (21) and the brake shoe (50). The pressure sensor (71) allows measuring the level of resistance to pedaling generated by the braking mechanism (49) (FIG. 6) which, when actuated, induces a compression force on the brake shoe support (21) and the brake shoe (50) against the lateral surface of the flywheel (4) (FIG. 1). FIG. 11 also shows the signal cables (72) of the pressure sensor (71) and the conditioning filter (51) of the pressure sensor signal (71). The filtered signal from the pressure sensor (71) is transmitted by the signal conductor cable (52) of the sensors.

In one embodiment of the invention, the front chain transmission system (5) and the rear chain transmission system (17) can be carried out by replacing said chains with belts that can be serrated, in the form of "V" or flat, and their respective and corresponding pulleys (18) and (26) replaced by toothed pulleys, with "V" or flat grooves.

In this order of ideas, the assisted rehabilitation device of the present invention, thanks to its configuration of elements such as the patient's pulsation sensor, the pedaling resistance level sensor and the pedal angular speed sensor, allows for systematic control of the performance of the user during the exercise routine, thus optimizing the patient's response to the rehabilitation treatment. In particular, the device adjusts the pedaling resistance and the pedaling rate automatically to the optimum range depending on the level of treatment required by the patient. As can be seen in FIG. 1, the motor (6) characterized in that it is a permanent magnet brushless motor, is coupled to the flywheel (4) of the bicycle by means of a front transmission chain (5), allowing the user to experience a variation in the rotation speed of the pedals (20) and (39) of the device giving it a variable range of pedaling frequency and muscle strengthening. A second motor (3) allows for automatically adjusting the level of resistance to the desired pedaling. This is achieved by operating the braking mechanism (49) of the bicycle in a controlled manner and on a gradual scale from zero initial resistance to total braking of the system. This automatic braking system also allows generating an emergency stop of the mechanism that is executed by activating the emergency stop button (11), protecting the patient from any abnormal situation that may occur during the rehabilitation session. At the beginning of the activity, the user inserts the parameters of resistance level and desired rotation speed by means of a touch screen (2) arranged for this purpose. Said input parameters are analyzed by the processing unit contained in the housing (10) that responds generating the requested level of rehabilitation thanks to the control signal sent to the motors (3) and (6).

In accordance with the foregoing, it is an object of the present invention to build an automatically controlled device for assisted rotation of the lower extremities, which allows the adjustment of speed and resistance to pedaling from a touch screen (2) according to the needs and condition of the user. Therefore, said device allows planning the design of a therapy session based on the particular requirements of a patient, for which it seeks to evaluate the performance parameters during rehabilitation, monitoring its progress. The system also allows adjustment of the rotation speed and pedaling resistance parameters in real time.

In this sense, the rehabilitation device according to the present invention is described as a system of various elements, namely: an exercise bike structure coupled to a motor (6) whose axle (73) is supported by metallic profiles (8), (29) and tabs (9) (FIG. 1) and (31) (FIG. 9). The motor (6) transfers the rotational movement to the flywheel (4) through a front drive chain (5). In turn, the rotational movement of the flywheel (4) is transferred to the pedals (20) and (39) through the rear drive chain (17) (FIG. 1). The system has a motor (3) that adjusts the degree of braking providing a variable resistance in the pedals (20) and (39). The motor (3) also allows to implement the emergency stop that is activated by pressing the emergency stop button (11) (FIG. 8). This way, the device automatically adjusts the pedaling rate and the resistance to pedaling based on the evaluation of the input parameters received by the microprocessor and the control and power electronics contained in the housing (10). This is done by collecting the data from the pressure sensor (71) (FIG. 11) and the photo-transmitter pulse sensor (42) (FIG. 5) that are embedded in the rehabilitation device. The data of these sensors are interpreted by the microprocessor, embedded in the housing (10), which sends the setpoint signals to the rotation speed regulation motor (6) (FIG. 1) and to the pedaling resistance leveling motor (3) (FIG. 1). This is achieved through the coupling of the signals coming from the sensors with a control algorithm. The device has an additional sensor (61) and (62) (FIG. 8) that allows the user's heart rate per minute to be measured. The microprocessor contained in the housing (10) (FIG. 1) records the data of pedaling cadence, pedaling resistance, and pulsations during a rehabilitation session. This record creates a database that can be viewed through a dashboard or touch screen (2). The database includes information such as the history of the progress in the level of exercise, the duration of the session, and the number of repetitions performed during a certain previously established exercise sequence.

The motor (3) (FIG. 6) that graduates the pedaling resistance together with the gear reducer (44) (FIG. 6) is coupled by means of steel cables (48) (FIG. 6) to the shoes (50) (FIG. 6) of the flywheel brakes (4) (FIG. 6), allowing not only to fulfill the function of generating different levels of resistance to pedaling but also to provide an emergency stop mechanism for the movement of rotation of the pedals that is activated by pressing the emergency stop button (11) (FIG. 8) protecting the user against any contingency that could interfere with the normal development of the rehabilitation session. The device also has adjustable links (16) and (13) (FIG. 1) that allow modifying the horizontal position of the saddle (14) (FIG. 1) and the vertical position of the handlebar (1) (FIG. 1) depending on the patient's body measurements.

The control electronics are stored in a housing (10) (FIG. 1) containing the integrated circuits responsible for processing the signals of the pedaling cadence sensor (42) (FIG. 5), the cardiac pulsation sensors (61) and (62) (FIG. 8) and pressure sensor (71) (FIG. 11) in order to generate the respective control action on the motors. Inside the housing (10) (FIG. 1) there are also power electronics necessary to allow the drive of the pedaling cadence regulator motor (6) and the pedaling resistance regulator motor (3). The power electronics also power the control system and the drive system. Said power supply comes from a bank of batteries stored in their respective container (7) (FIG. 1).

The invention claimed is:

1. An assisted rehabilitation system, comprising:

a handlebar;

a touch screen;

two pedals;

an engine that automatically graduates resistance to pedaling;

an emergency stop button which, when pressed, immediately stops the system's rotation movement at any time;

a pressure sensor located on a first brake shoe;

a flywheel that reduces angular velocity fluctuations;

a speed regulation motor that transmits movement to said flywheel by means of a front drive chain that engages a first toothed pulley and a second toothed pulley;

a metal structure that houses a plurality of control electronics and power electronics, wherein said control and power electronics are powered by a battery bank located inside said metal structure;

wherein an electrical connection between said battery bank and said metal structure is achieved by means of a power cable;

a pulse photo-transmitter sensor that is adapted to read the stride frequency of the teeth of a third toothed pulley that is attached to the two pedals through a connecting rod.

2. The assisted rehabilitation system according to claim 1, wherein a distance between the centers of the first toothed pulley and the second toothed pulley is adjusted by means of screws that are housed in two tongues which serve as a support for an axis of said speed regulating motor, and wherein said speed regulating motor rests on a metal structure formed by two vertical supports which in turn are joined by two rectangular profiles.

3. The rehabilitation system according to claim 1, wherein the connection of the first toothed pulley with said flywheel is done by means of four screws that pass through said flywheel and a plurality of screws that connect a front support of a bicycle frame with a support structure and two screws that allow adjustment of the distance between the centers of the first toothed pulley and the second toothed pulley and which rest on a plurality of tabs.

4. The rehabilitation system according to claim 1, further comprising an adjustment system comprising through screws that secure the second toothed pulley to said motor, and an internal clamping system that holds the second toothed pulley to said motor and wherein said internal clamping system internally houses a friction power transmission system.

5. The rehabilitation system according to claim 1, wherein said pulse photo-transmitter sensor measures the rotation speed of the two pedals at any time by reading a frequency of passage of the teeth of the third toothed pulley connected to the two pedals through the connecting rod, and the photo-transmitter sensor is mounted on a printed circuit board which houses components to acquire the signal generated by said pulse photo-transmitter sensor.

6. The rehabilitation system according to claim 1, further comprising:

a gear reducer, wherein said motor and said gear reducer are fixed to a bicycle frame by means of a support plate and through screws;

wherein said gear reducer rotates jointly with a screw shaft that tenses a steel cable and drives a braking mechanism;

wherein said motor comprises an encoder;

wherein an electronic circuit allows the reading of a signal from said encoder and said electronic circuit is fed by cables;

and wherein said signal is obtained through a reader cable.

7. The assisted rehabilitation system according to claim 1, wherein a rotation speed signal of said pedals said the photo-transmitter sensor is fed to a touchscreen by means of a sensor signal conductor cable, which is connected to said touchscreen cable by means of a connector and wherein said sensor signal conductor cable also obtains a pressure sensor signal located in a brake shoe and a heartrate signal from the heart rate sensors located on said handlebar.

8. The assisted rehabilitation system according to claim 1, wherein said motor's shaft is located axially by means of a plurality of external and internal adjustment nuts, which allow the first toothed pulley and the second toothed pulley to align with each other for proper transmission of motor rotation movement towards said flywheel.

9. The assisted rehabilitation system according to claim 1, wherein said chain is replaced by a V-shaped or flat toothed belt, and the first toothed pulley and the second toothed pulley are replaced by toothed pulleys with V-shaped or flat grooves.

* * * * *